United States Patent [19]

Igarashi et al.

[11] Patent Number: 4,797,384

[45] Date of Patent: Jan. 10, 1989

[54] HEAT-SENSITIVE RECORDING SHEET

[75] Inventors: Akira Igarashi; Akihiro Shimomura; Shinichiro Serizawa, all of Shizuoka, Japan

[73] Assignee: Fuji Photo Film Co., Ltd., Kanagawa, Japan

[21] Appl. No.: 150,274

[22] Filed: Jan. 29, 1988

[30] Foreign Application Priority Data

Jan. 29, 1987 [JP] Japan ..... 62-18950

[51] Int. Cl.[4] ..... B41M 5/18

[52] U.S. Cl. ..... 503/200; 427/152; 428/211; 428/342; 428/913; 428/914; 503/214; 503/226

[58] Field of Search ..... 427/150–152; 428/211, 342, 913, 914; 503/200, 214, 226

[56] References Cited

U.S. PATENT DOCUMENTS 4,590,499 5/1986 Fujimura et al. ..... 503/200

4,720,480 1/1988 Ito et al. ..... 503/227

*Primary Examiner*—Bruce H. Hess

*Attorney, Agent, or Firm*—Sughrue, Mion, Zinn, Macpeak, and Seas

[57] ABSTRACT

A heat-sensitive recording sheet is disclosed, comprising a paper support and a heat-sensitive color forming layer provided on one side of the paper support and an antistatic layer provided on the other side of the paper support, wherein the antistatic layer containing at least one polymer of homopolymers and copolymers of vinyl compounds having a sulfonic acid group, having a weight-average molecular weight of at least 5,000 and at least one surfactant selected from sulfosuccinates, alkylbenezenesulfonic acid salts and naphthalenesulfonic acid salts.

This heat-sensitive recording sheet is improved in print running properties under low humidity conditions.

8 Claims, No Drawings

HEAT-SENSITIVE RECORDING SHEET

FIELD OF THE INVENTION

The present invention relates to a heat-sensitive recording sheet and more particularly to a heat-sensitive recording sheet which is improved in print running properties under low humidity conditions.

BACKGROUND OF THE INVENTION

A heat-sensitive recording sheet is produced by coating a compound capable of forming color upon application of heat, on a paper support. Various types of heat-sensitive recording sheets have been proposed.

For example, U.S. Pat. Nos. 3,666,525, and 4,471,074 disclose a heat-sensitive recording sheet using a combination of an electron-donating dye precursor and an electron accepting compound; U.S. Pat. Nos. 2,663,654 through 2,663,657 disclose a combination of the ferric salt of higher fatty acid and a polyhydric hydroxy compound; and U.S. Pat. Nos. 4,650,740, 3,695,885, and 4,411,979 disclose a heat-sensitive recording sheet using a combination of diazo sulfonate, a coupler and an alkaline substance. In addition, a system wherein azo, oxazine or formazane dyes are formed through the heat reaction of resorcinic acid and 3-nitro-5-methylsalicylic acid is known, as described in, for example, Japanese Patent Publication Nos. 18992/62 and 9240/63.

These heat-sensitive recording sheets are advantageous in that: (1) primary color-formation is employed and no development is needed, (2) the quality of the sheet is similar to that of the ordinary paper. and (3) handling is easy.

In recent years, such heat-sensitive recording sheets have been widely used in the fields of, e.g., facsimile machines, recorders and printers, and its demand is increasing.

Heat-sensitive recording as heretofore employed, comprised a recording system in which the recording speed is relatively slow. However, with an increase in the quality of a printing heat (i.e., a thermal head) and also an increase in the sensitivity of the heat-sensitive recording sheet, the recording speed has been greatly increased. However, with development of high speed recording, various problems have arisen. One of the problems is that static electricity is generated when the heat-sensitive recording sheet runs at a high speed, causing poor running such as jamming. This tendency is more marked under lower temperature and lower humidity conditions. The cause of these poor running tendencies is considered to be that when the heat-sensitive recording sheet runs at a high speed, friction is produced between the heat-sensitive recording sheet and a thermal head, a body or a platen roll, as a result of which static electricity is generated.

SUMMARY OF THE INVENTION

An object of the present invention is to overcome the above problems by providing a heat-sensitive recording sheet which produces less frictional charging at the time of heat-sensitive recording and thereby reduces poor running.

It has been found that this object of the present invention is attained by providing a heat-sensitive colorforming layer on one side of a paper support, and an antistatic layer containing: (a) at least one polymer of homopolymers and copolymers of vinyl compounds having a sulfonic acid group, having a weight-average molecular weight ($\overline{M}w$) of at least 5,000; and (b) at least one surfactant selected from sulfosuccinates, alkylbenzenesulfonic acid salts and naphthalenesulfonic acid salts, on the other side of the paper support.

The present invention is thus directed to a heat-sensitive recording sheet comprising a paper support, on one side of which a heat-sensitive color forming layer is provided, and on the other side of which an antistatic layer is provided, wherein said antistatic layer contains: (a) at least one polymer of homopolymers and copolymers of vinyl compounds having a sulfonic acid group, having a weight-average molecular weight of at least 5,000; and (b) at least one surfactant selected from sulfosuccinates, alkylbenzenesulfonic acid salts and naphthalenesulfonic acid salts.

DETAILED DESCRIPTION OF THE INVENTION

Homopolymers or copolymers of vinyl compounds having a sulfonic acid group, having a weight-average molecular weight of at least 5,000 which as used in the present invention include for example, the sodium salts, potassium salts and lithium salts of polyvinylsulfonic acid, polystyrenesulfonic acid, polypropylenesulfonic acid, polyisobutylenesulfonic acid, polyvinyltoluenesulfonic acid, and polyvinylbutyralsulfonic acid.

By providing the antistatic layer of the present invention on the back surface of the heat-sensitive recording sheet, the amount of static electricity produced on the heat-sensitive recording sheet under low humidity conditions is greatly decreased and print running properties are improved.

Several proposals to prevent the formation of static electricity during the running process of the heat-sensitive recording sheet have been made. These proposals are directed to the incorporation of e.g., inorganic electrolytes and surfactants in the heat-sensitive recording sheet. However, these heat-sensitive recording sheets have several disadvantages.

In the case of heat-sensitive recording, the surface of a thermal head to be used in recording is made of glassy substances such as tantalum pentaoxide and silicon carbide. Thus, a voltage applied at the time of recording, or heat generated thereby, causes an electrolytic corrosion reaction with the inorganic electrolyte as a medium and therefore, a problem may occur in that the thermal head is broken. Accordingly, it is necessary to minimize the amounts of inorganic ions, particularly alkali metals and halogens, contained in the thermal head.

From this viewpoint, it is undesirable to use the inorganic electrolyte containing a large amount of inorganic ions. In the case of inorganic electrolytes or surfactants, it is necessary to add them in large amounts in order to obtain the necessary antistatic effect. Furthermore, the antistatic effect of such inorganic electrolytes; or surfactants is small under low humidity conditions.

The present inventors have searched for an antistatic agent with which the sufficient antistatic effect can be obtained even when used in a small amount and furthermore, which is effective under low humidity conditions. As a result, it has been found that a very high antistatic effect can be obtained by using a combination of at least one polymer selected from the homopolymers and copolymers of vinyl compounds having a sulfonic acid group and at least one surfactant selected from sulfosuccinates, alkylbenzenesulfonic acid salts and naphthalenesulfonic acid salts.

The present inventors have investigated polystyrenesulfonic acid salts and have discovered that of the polystyrenesulfonic acid salts, those having a relatively small molecular weight, which have been conventionally used as electroconductive agents, are not necessarily preferred as electroconductive agents for the present heat-sensitive recording sheet.

That is, almost all of the static electricity generated at the time of heat-sensitive recording is in a platen roll and on the back surface to the recording surface of the heat-sensitive recording sheet, thus, the electroconductivity of the heat-sensitive recording sheet is most important in the back surface of the heat-sensitive recording sheet. In the case of low molecularweight polymers, even if the polymer is coated on the back surface of the heat-sensitive recording sheet, it diffuses in the paper with time and the necessary antistatic effect cannot be obtained. It has also been found that if the molecular weight is too small (that is, in the case of monomers or dimers), some of the polymers reach the heat-sensitive color forming layer and accelerate the electrolytic corrosion reaction of the thermal head. It has also been found that if the molecular weight is small, when the heat-sensitive recording sheet is stored in a roll form the polymer coated on the back surface is transferred to the top surface of the heat-sensitive recording sheet (i.e., recording surface), and the same phenomenon occurs as in the permeation of the polymer. In order to overcome this problem, it has been found that the weight-average molecular weight is at least 5,000 and preferably at least 10,000. There is no specific limitation as to the upper limit of the molecular weight of the polymer. However, in view of suitability regarding coating onto the heat-sensitive recording sheet, polymers having an excessive molecular weight are not preferred; that is, the weight-average molecular weight is preferably not more than 500,000 and more preferably not more than 200,000.

Representative examples of the appropriate surfactant include, for example, the potassium salts, sodium salts and lithium salts of dioctylsulfosuccinic acid, didodecylsulfosuccinic acid, dodecylbenzenesulfonic acid, octadecylbenzenesulfonic acid, naphthalenesulfonic acid, methylnaphthalenesulfonic acid, and butylnaphthalenesulfonic acid.

A method of producing the heat-sensitive recording sheet of the present invention is hereinafter explained.

A method of producing a heat-sensitive recording sheet comprising an electron-donating dye precursor and an electron-accepting compound is described in detail in, for example, U.S. Pat. Nos. 4,489,337, 4,520,377, 4,576,831, and 4,415,633.

A method of producing a heat-sensitive recording sheet utilizing diazo compounds is described in detail in, for example, U.S. Pat. Nos. 4,650,740, 4,644,376, 4,652,512, and 4,411,979.

In the present invention, a heat-sensitive color forming layer component is coated one side of the paper support.

On the back side of the paper support is coated an antistatic layer containing: (a) at least one polymer of homopolymers and copolymers of vinyl compounds having a sulfonic acid group, having a weight-average molecular weight of at least 5,000; and (b) at least one surfactant selected from sulfosuccinates, alkylbenzenesulfonic acid salts and naphthalenesulfonic acid salts.

Ths mixing ratio of the polymer to the surfactant is preferably from 100:0.5 to 100:20 and more preferably from 100:1 to 100:10 (by weight). The mixing ratio exceeding 100:20 can also be used, but it is difficult to obtain the desired effect of the present invention. The amount of the polymer of the antistatic agent of the present invention coated on the back surface is from 0.02 to 1 g/m$^2$ and preferably from 0.05 to 0.5 g/m$^2$. If the amount of the polymer is less than 0.02 g/m$^2$, the antistatic effect is insufficiently high. On the other hand, if the amount of the polymer is more than 1 g/m$^2$, problems, such as sticking under high humidity conditions, may occur.

To the antistatic agent solution of the present invention, inorganic pigments, metallic soap, wax, etc., can be added in order to increase whiteness, sliding properties, etc.

The combination of at least one polymer and at least one surfactant as described above may possibly be incorporated in a heat-sensitive recording layer or in an intermediate layer between the heat-sensitive recording layer and the support. However, this is not preferred, because in many cases fog occurs when the heat-sensitive recording sheet is stored for a long period of time or under high humidity conditions since the sulfonic acid group is a strong acid.

The present invention is described in greater detail with reference to the following examples, although it should not be construed as being limited thereto.

EXAMPLES 1 TO 3, AND COMPARATIVE EXAMPLES 1 TO 3

Five (5) g of 2-anilino-3-methyl-6-cyclohexylmethylaminofluoran, as an electron-donating dye precursor, and 25 g of a 5% solution of polyvinyl alcohol, having a degree of saponification of 98% and a degree of polymerization of 500, were dispersed in a 100-milliliter ball mill to form a dispersion having an average particle diameter of 1.0 μm.

On the other hand, 10 g of 1.1-bis(4-hydroxyphenyl)-propane, as an electron accepting compound, and 10 g of β-naphthylbenzyl ether, as a heat fusible substance, were dispersed in a 300-milliliter ball mill along with 100 g of a 5% solution of polyvinyl alcohol to obtain a dispersion having an average particle diameter of 1.2 μm.

The above two dispersions were mixed, and a dispersion of 15 g of calcium carbonate in 15 g of water was added thereto. In addition, 10 g of a 30% dispersion of zinc stearate (Hidrin Z-7, manufactured by Chukyo Yushi Co., Ltd.) was added to prepare a heat-sensitive coating solution.

This heat-sensitive coating solution was coated on a high quality paper (basis weight, 50 g/m$^2$) with a Meyer bar in such an amount that the amount of solids was 5 g/m$^2$, dried at 50° C. and then subjected to calendering at 2 kgw/cm to obtain a heat-sensitive recording sheet.

On the back of the heat-sensitive recording sheet as prepared above, a solution of a 100:1 mixture (by weight) of sodium polystyrenesulfonate having a weight-average molecular weight of 10,000 and sodium di(2-ethylhexyl) sulfosuccinate with a bar coater was coated in such an amount that the amount of the polystyrenesulfonic acid salt coated varied from 0.01 to 2 g/m$^2$ as shown in Table 1. The amount of the polystyrenesulfonic acid salt thus coated was varied by changing the concentration of the solution of the above mixture.

The surface resistance of the back of the heat-sensitive recording sheet under conditions of 10° C. and 15% RH was measured according to ASTM D-257-21, and the static electricity generated when the heat-sensitive recording sheet was recorded on a Model OF-23 facsimile (manufactured of Oki Denki K.K.) under the same conditions as above and measured.

In the measurement, heat-sensitive recording sheet having good print running properties under low humidity conditions showed the surface resistance of $5\times10^{12}$ or less and the static voltage of 2000 V or less.

TABLE 1

| Run No. | Amount of Sodium Polystyrene-sulfonate Coated ($g/m^2$) | Surface Resistance (Ω) | Static Voltage (V) |
|---|---|---|---|
| Example 1 | 0.05 | $4\times10^{12}$ | 1,100 |
| Example 2 | 0.50 | $1\times10^{11}$ | 560 |
| Example 3 | 1.0 | $8\times10^{10}$ | 420 |
| Comparative Example 1 | No coating | $8\times10^{14}$ | 106,000 |
| Comparative Example 2 | 0.01 | $2\times10^{13}$ | 42,000 |
| Comparative Example 3 | 2.0 | $7\times10^{10}$ | 290 |

From the results shown in Table 1, it is seen that the recording sheets according to the present invention show excellent properties.

Further, the recording sheet in Comparative Example 3 became sticky and difficulty in handling was caused.

EXAMPLES 4 TO 7, AND COMPARATIVE EXAMPLES 4 AND 5

The procedure of Example 1 was repeated wherein the amount of sodium polystyrenesulfonate coated was fixed to 0.3 $g/m^2$, and the mixing ratio of sodium polystyrenesulfonate (polymer) to sodium di(2-ethylhexyl)-sulfosuccinate (surfactant) was changed as shown in Table 2.

The results are shown in Table 2.

TABLE 2

| Run No. | Polymer/Surfactant (by weight) | Surface Resistance (Ω) | Static Voltage (V) |
|---|---|---|---|
| Example 4 | 100/0.5 | $3\times10^{11}$ | 620 |
| Example 5 | 100/1 | $3\times10^{11}$ | 500 |
| Example 6 | 100/10 | $4\times10^{11}$ | 720 |
| Example 7 | 100/20 | $9\times10^{11}$ | 910 |
| Comparative Example 4 | 100/0 | $3\times10^{11}$ | 4,500 |
| Comparative Example 5 | 100/30 | $2\times10^{12}$ | 1,200 |

From the results shown in Table 2, it is seen that the recording sheets according to the present invention show excellent print running properties.

Further, when the surfactant was used in excess in an antistatic layer as in Comparative Example 5, the improvement in print running properties could not be found out.

EXAMPLES 8 TO 12, AND COMPARATIVE EXAMPLES 6 TO 9

The procedure of Example 1 was repeated wherein the type of the polymer and the type of the surfactant were varied as shown in Table 3, the mixing ratio was adjusted to 100:5, and the amount of the polymer coated was 0.2 $g/m^2$.

The results are shown in Table 3.

TABLE 3

| Run No. | Type of Polymer | Type of Surfactant | Surface Resistance (Ω) | Static Voltage (V) |
|---|---|---|---|---|
| Example 8 | Sodium polystyrenesulfonate Mw: 10,000) | Sodium dodecylbenzene-sulfonate | $6\times10^{11}$ | 960 |
| Example 9 | Sodium polystyrenesulfonate (Mw: 10,000) | Sodium naphthalene-sulfonate | $6\times10^{11}$ | 810 |
| Example 10 | Potassium polystyrene-sulfonate (Mw: 50,000) | Sodium di(2-ethylhexyl) sulfosuccinate | $2\times10^{11}$ | 380 |
| Example 11 | Sodium polyisobutylene- | Sodium di(2-ethylhexyl) sulfosuccinate | $1\times10^{12}$ | 720 |
| Example 12 | Potassium polyvinyl-toluenesulfonate (Mw: 10,000) | Sodium di(2-ethylhexyl) sulfosuccinate | $2\times10^{12}$ | 610 |
| Comparative Example 6 | Sodium polyacrylate | Sodium di(2-ethylhexyl) sulfosuccinate | $4\times10^{13}$ | 5,100 |
| Comparative Example 7 | Polyvinyl alcohol | Sodium di(2-ethylhexyl) sulfosuccinate | $7\times10^{14}$ | 10,200 |
| Comparative Example 8 | Sodium polystyrene-sulfonate (Mw: 10,000) | Polyethyleneglycol monostearate | $5\times10^{11}$ | 2,800 |
| Comparative Example 9 | Sodium polystyrene-sulfonate (Mw: 10,000) | Sorbitan monostearate | $6\times10^{11}$ | 3,100 |

From the results shown in Table 3, it is seen that the recording sheets according to the present invention show excellent print running properties.

While the invention has been described in detail and with reference to specific embodiments thereof, it will be apparent to one skilled in the art that various changes and modifications can be made therein without departing from the spirit and scope thereof.

What is claimed is:

1. A heat-sensitive recording sheet comprising a paper support, on one side of which a heat-sensitive color forming layer is provided, and on the other side of which an antistatic layer is provided, wherein said antistatic layer contains: (a) at least one polymer of homopolymers and copolymers of vinyl compounds having a sulfonic acid group, having a weight-average molecular weight of at least 5,000; and (b) at least one surfactant selected from sulfosuccinates, alkylbenzenesulfonic acid salts and naphthalenesulfonic acid salts.

2. A heat-sensitive recording sheet as in claim 1, wherein the weight-average molecular weight of the polymer is at least 10,000.

3. A heat-sensitive recording sheet as in claim 2, wherein the polymer has a weight-average molecular weight of not more than 500,000.

4. A heat-sensitive recording sheet as in claim 2, wherein the polymer has a weight-average molecular weight of not more than 200,000.

5. A heat-sensitive recording sheet as in claim 1, wherein the mixing ratio of the polymer to the surfactant is from 100:0.5 to 100:20.

6. A heat-sensitive recording sheet as in claim 1, wherein the mixing ratio of the polymer to the surfactant is from 100:1 to 100:10.

7. A heat-sensitive recording sheet as in claim 1, wherein the polymer is contained in the antistatic layer in an amount of from 0.01 to 1 $g/m^2$.

8. A heat-sensitive recording sheet as in claim 1, wherein the polymer is contained in the antistatic layer in an amount of from 0.05 to 0.5 $g/m^2$.

* * * * *